US007322484B2

(12) United States Patent
Batten

(10) Patent No.: US 7,322,484 B2
(45) Date of Patent: Jan. 29, 2008

(54) MOISTURE SHEDDING SYSTEM

(75) Inventor: Keith Geoffrey Batten, Wynnum (AU)

(73) Assignee: Redmond Gary Australia Pty. Ltd., Ernest (AU)

( * ) Notice: Subject to any disclaimer, the term of this patent is extended or adjusted under 35 U.S.C. 154(b) by 205 days.

(21) Appl. No.: 10/487,448

(22) PCT Filed: Jul. 1, 2002

(86) PCT No.: PCT/AU02/00860

§ 371 (c)(1),
(2), (4) Date: Feb. 23, 2004

(87) PCT Pub. No.: WO03/018460

PCT Pub. Date: Mar. 6, 2003

(65) Prior Publication Data

US 2004/0247392 A1 Dec. 9, 2004

(30) Foreign Application Priority Data

Aug. 24, 2001 (AU) ..... 65423/01

(51) Int. Cl.
*B66C 23/00* (2006.01)

(52) U.S. Cl. ..... 212/347

(58) Field of Classification Search ..... 212/271, 212/374, 347

See application file for complete search history.

(56) References Cited

U.S. PATENT DOCUMENTS 3,385,395 A * 5/1968 Kurt et al. ..... 181/230
3,418,967 A * 12/1968 Donkersloot ..... 116/173
3,710,950 A * 1/1973 Pottorff et al. ..... 212/294
5,409,345 A * 4/1995 Pinkston ..... 414/563
5,878,540 A * 3/1999 Morstein ..... 52/296
6,164,468 A * 12/2000 Erdmann ..... 212/348

* cited by examiner

*Primary Examiner*—Thomas J. Brahan
(74) *Attorney, Agent, or Firm*—Foley & Lardner, LLP

(57) ABSTRACT

A moisture shedding system for hollow boom (30) is disclosed. The system has at least one drainage aperture (38) in or adjacent a lower wall of the boom and a fluid director (45) is associated with the aperture for directing fluid on the inner surface of the lower wall to the aperture to allow fluid to be drained from the boom.

18 Claims, 8 Drawing Sheets

30
32
31
34

34
30
31
39
32
38
30
38
35
38
33

37
32
31
33

30
37
38
33
31
32
38

30

34
30
36
37
39
38
35

30

38
35
38
30

38
38
35
38
38
30
38

38
38
30

35

30
35
36
37
38
40
42
43

30

30
30

44
37

30
36
38
35
36
35
37

45

37
36
38
35
37

36
45
30
30

30
30

44
36
38
38
30

E
E
30
38

38
30

45
36
38
38
30

H
H
30

45
45
30

46
36
38
35
37

30
46
30

46
35

38
42
42
L
L
35
38
51
50

38
50
42
38
35

38
M
M
38
35
52
53

38
35

38
K
K
38

54
55

35

30
60

61
62
34
63
37

30
38
62
38
35
63
38
30
34
62
60

60
30

36
62
63
37
63

30
62

63

MOISTURE SHEDDING SYSTEM

This inventions concerns a moisture shedding system for booms. In particular, the invention concerns a moisture shedding system for booms employed in elevated work platforms (EWP).

The invention will be described by way of example in relation to booms of elevated work platforms. It should be appreciated that the invention may also be used with booms other than those employed in EWP's. For example, the system of the invention may be employed in cranes, erection and recovery units (ERU) or in any other equipment incorporating booms that may may be used in the proximity to live high voltage electrical cables.

EWP's are employed to allow maintenance personnel to perform installation and repair work on or closely adjacent to live electrical conductors. In order to perform this work without the need to interrupt the supply of power, the work is performed while the conductors are live. EWP's have a plurality of booms with the final boom being adapted to carry a basket for personnel at one end and having its other end coupled to an end of a final stage of a telescopic or knuckle type boom.

The final boom and/or a lower boom is constructed to be electrically non-conductive and thus the basket is electrically isolated.

Some EWP's are designed for allowing work to be performed on installations carrying low voltages and voltages up to 132 kV or higher.

The final boom is typically of a hollow construction. Where high voltages are involved and when the EWP is used when rain is falling it is important that a continuous film of water does not form or is not caused to run through and along the interior of the final boom. For safe working conditions, the total maximum leakage current along the final boom should not exceed 5 mA (as per Australian Standard AS 3859 guidelines). If the leakage current exceeds this level the EWP cannot be used with safety around live lines.

SUMMARY OF THE INVENTION

It is an object of the present invention to provide a moisture shedding system for booms which allows EWP's to be used in inclement weather and which ensures that the maximum safe working current leakage is not exceeded.

According to one aspect of the invention, there is provided a moisture shedding system for a hollow boom, the system having at least one drainage aperture in or adjacent to a lower wall of the boom and a fluid director for directing fluid on the lower wall towards the at least one aperture to thereby drain fluid from an inner surface of the lower wall of the boom.

Preferably a plurality of drainage apertures are present in or adjacent the lower wall of the boom. The apertures may be arranged at spaced locations along the boom. The spacing may be even or uneven. Where a plurality of apertures are present, all of the apertures may be present in the lower wall of the boom or all may be present adjacent to the lower wall. Preferably, some of the apertures may be present in the lower wall of the boom and some may be present adjacent to the lower wall.

The apertures may consist of apertures of any desired shape. Preferably, the apertures are either circular holes or slots.

The fluid director may be provided by a suitable profile in the lower wall of the boom. For example the lower wall of the boom may have a concave profile to thereby form a channel extending along the wall. The drainage apertures may be present in the channel, in this way the concave profile directs fluid to the apertures and the formation of a continuous stream of fluid extending along the inner surface of the lower wall of the boom is thereby avoided. The channel may be located midway across the width of the lower wall although this need not be the case.

The fluid director may be provided by forming the lower wall with an inner convex profile. With such a profile apposed channels are formed at the location where side walls of the boom meet with the lower wall of the boom. The drainage apertures may either be located in the lower wall and in the channels extending along opposed edges of the lower wall or in the side walls and adjacent the channels. The convex profile directs fluid on the inner surface of the lower wall into the two channels and the apertures allow the fluid to escape from the interior of the boom. In this way, the formation of a continuous stream of fluid extending along the inner surface of the boom is thereby avoided.

In another embodiment the inner wall is provided with at least one well extending completely across the wall. A drainage aperture may be present in the well. Preferably a plurality of wells arranged at spaces locations along the inner wall are present and each well has a drainage aperture.

In yet another embodiment the directors are provided by upstanding fluid directing projections on the inner surface of the lower wall of the boom. The projections extend completely across the lower wall and direct fluid to the apertures in the lower wall or to the apertures in the side wall and adjacent to the lower wall.

When the drainage apertures are formed in the lower wall it is preferable to provide a run-off formation which cooperates with the apertures to prevent dribbling of the fluid along the outer surface of the lower wall of the boom.

BRIEF DESCRIPTION OF THE DRAWINGS

A particular preferred embodiment of the invention will now be described by way of example with reference to the drawings in which.

DETAILED DESCRIPTION OF THE PREFERRED EMBODIMENT

FIGS. 1A to 1F show various views of a boom 30 which incorporates the water shedding system of the invention. The boom 30 has a distal end 31 to which a personnel basket may be attached and a proximal end 32 which may be attached to an adjacent boom of a EWP of which the boom 30 forms a component part. The boom 30 is hollow as shown in the longitudinal sectional view of FIG. 1B. The distal end 31 is provided with attachment flanges 33 which allow that end to be attached to a personnel basket (not shown).

Figures 1A, 1B, 1C, 1D, 1E, 1F:
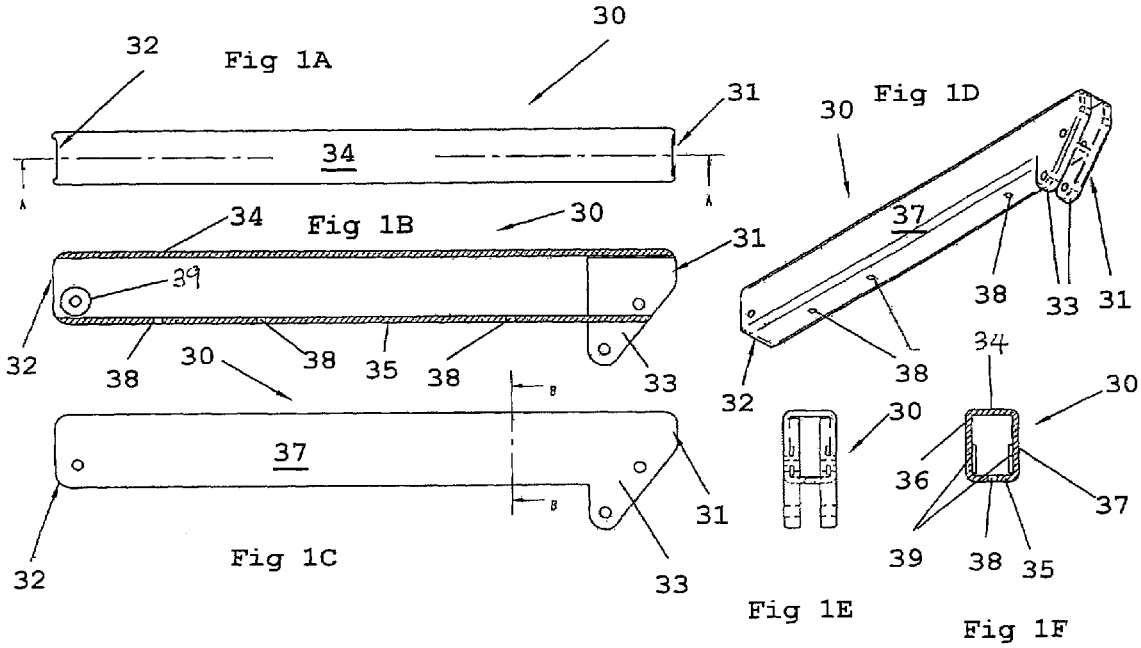
FIG. 1A is a plan view of a boom which may incorporate the moisture shedding system of the invention.
FIG. 1B is a sectional view of the boom of FIG. 1A taken along lines M.
FIG. 1C is an elevational view of the boom shown in FIG. 1A.
FIG. 1D is a perspective view of the boom shown in FIG. 1A.
FIG. 1E is an end view of the boom shown in FIG. 1A.
FIG. 1F is a sectional view of the boom of FIG. 1C taken along lines B B.

With reference to FIG. 1F, the boom has an upper wall 34 and an opposed lower wall 35. Opposed side walls 36 and 37 complete the hollow configuration of the boom. The lower wall 35 is provided with a plurality of spaced drainage apertures 38.

The proximal end 32 is provided with attachment formations 39 which allow that end to be attached to another boom of the EWP. The boom 30 is made from an electrically non-conducting material such as glass reinforced fibreglass.

Figures 2A, 2B, 2C, 2D:
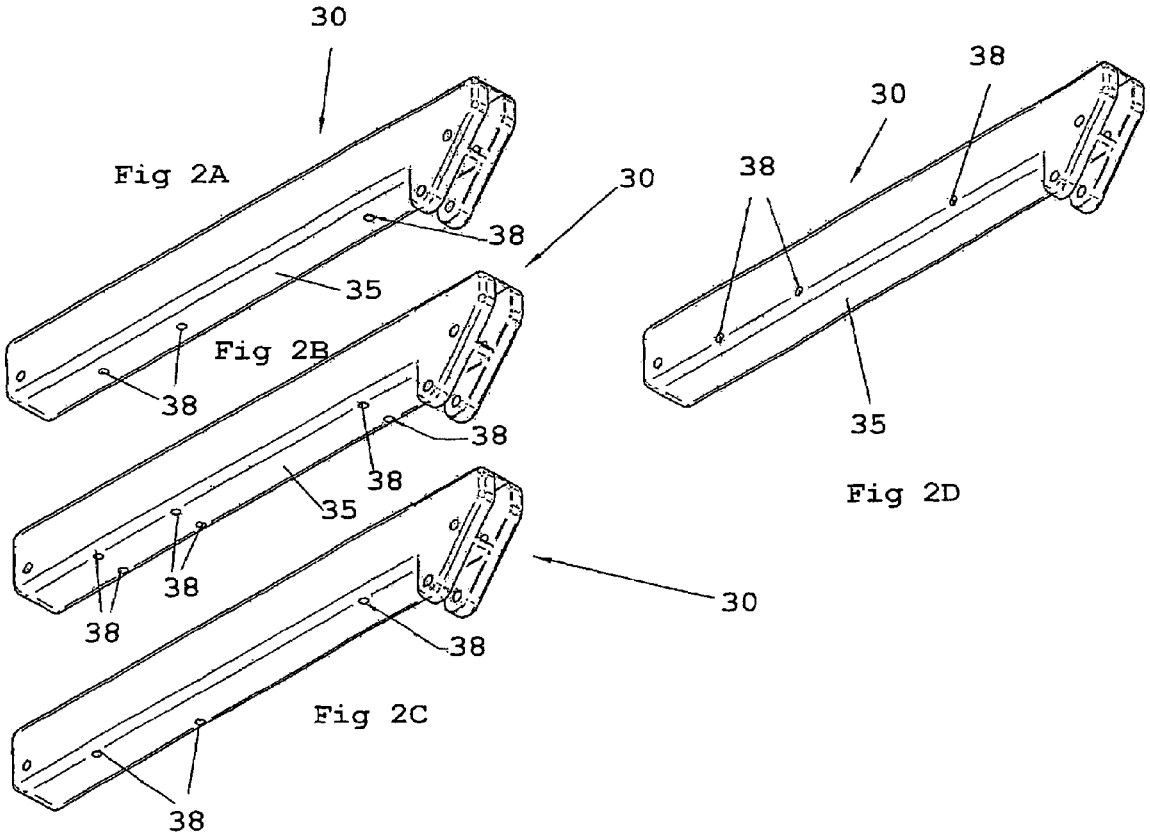
FIGS. 2A through to 2D are perspective views of the boom showing various locations at which drainage apertures of the moisture shedding system of the invention may be located.

FIGS. 2A to 2D show perspective views of the boom 30 and illustrate alternative locations at which the drainage apertures 38 may be located relative to the boom 30. In FIG. 2A the apertures are present in the lower wall 35 of the boom and are located at spaced locations along the boom. In FIG. 2B, the apertures 38 are arranged as pairs of apertures located at spaced locations along and in the lower wall 35 of the boom. In FIG. 2C, the apertures 38 are arranged at spaced locations along the lower wall of the boom and are arranged in a staggered relationship to each other. In FIG. 2D, the apertures 38 are located in the side wall 36 of the boom 30 and at a locations in that wall closely adjacent the lower wall 35. In FIG. 2D the apertures are arranged and are present at spaced locations along the wall 36.

Figures 3A, 3B, 3C, 4A, 4B, 4C, 5A, 5B, 5C:
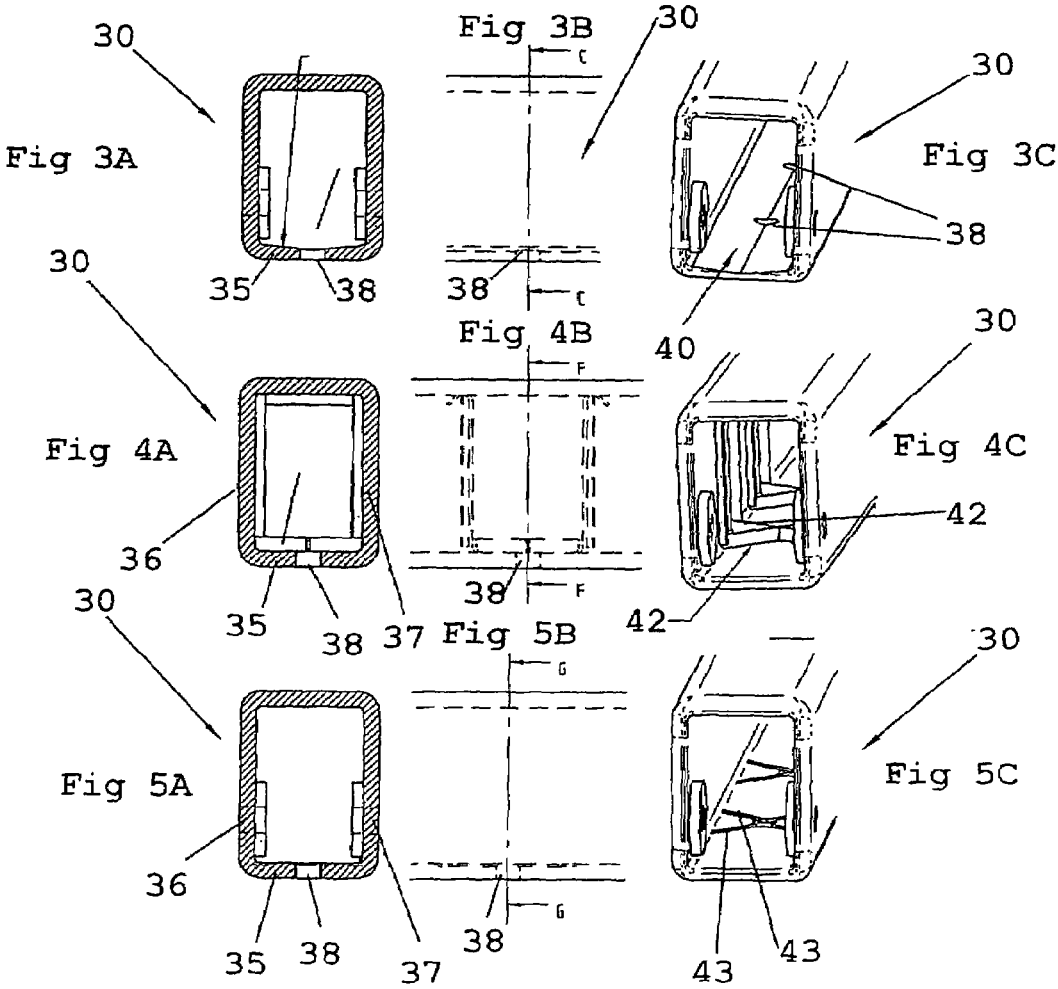
FIGS. 3A, 3B and 3C are transverse sectional side elevational and perspective views of part of a boom showing a moisture shedding system according to one embodiment of the invention.
FIGS. 4A, 4B and 4C are transverse sectional, elevational and perspective views of part of a boom showing a moisture shedding system according to another embodiment of the invention.
FIGS. 5A, 5B and 5C are transverse sectional, elevational and perspective views of part of a boom showing a moisture shedding system according to another embodiment of the invention.

FIGS. 3A, 3B and 3C show a portion of a boom 30 with drainage apertures formed in the lower wall 35. An inner surface of the lower wall 35 is provided with a fluid director which in this embodiment consists of a concave profile 40. The concave profile provides a channel 41 which directs fluid to the apertures 38 so that the fluid may escape from within the boom 30.

FIGS. 4A, 4B and 4C show portions of a boom 30 having an alternative moisture shedding system to that shown in FIG. 3. In FIG. 4, the director consists of upstanding projections 42 which extend upwardly from an inner surface of the lower wall 35. The projections form a cross shaped weir which extends entirely across the inner surface of the upper wall 35 and extends between side walls 36 and 37 of the boom. The projections 42 cross in the region above the drainage apertures 38 and function to direct fluid on the inner surface of the lower wall 35 towards the apertures 38 so that the fluid may escape from within the hollow boom 30.

FIGS. 5A, 5B ad 5C shown an alternative moisture shedding system to that illustrated in FIG. 4. In FIG. 5 the fluid director consists of ribs 43 arranged as mirror symmetrical V shaped ridges which extend from side wall 36 to side wall 37 of the boom. The apex of one of these ribs 43 is closely adjacent to the apex of the other rib 43 and the apex of each of the ribs are closely adjacent to one another in the vicinity of the drainage apertures 38. The ribs 43 function to direct fluid on the inner surface of the lower wall 35 of the boom towards the drainage apertures 38.

Figures 6A, 6B, 6C, 7A, 7B, 7C:
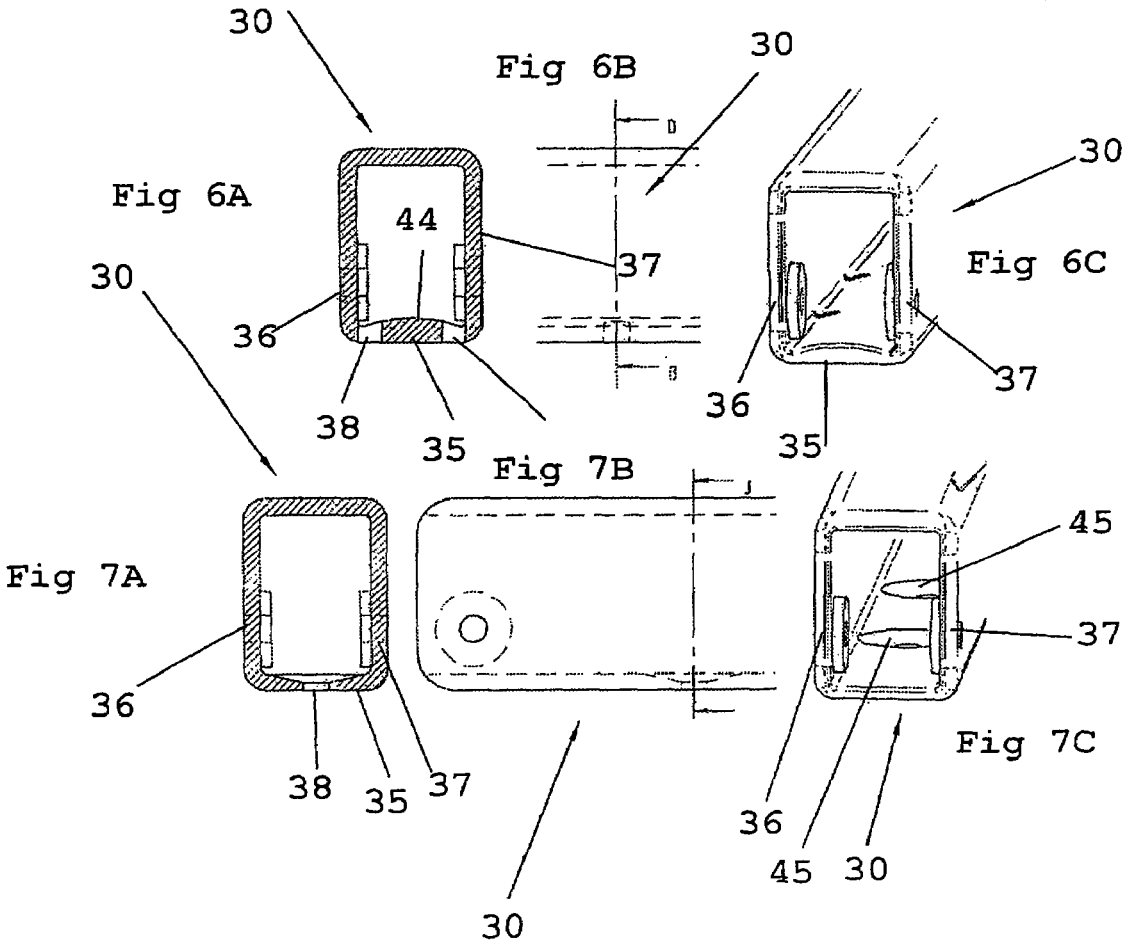
FIGS. 6A, 6B and 6C are transverse sectional, elevational and perspective views of part of a boom including a moisture shedding system according to another embodiment of the invention.
FIGS. 7A, 7B and 7C are transverse sectional, elevational and perspective views of part of a boom showing a moisture shedding system is according to another embodiment of the invention.

FIGS. 6A, 6B and 6C show an alternative moisture shedding system to that shown in FIGS. 3, 4 and 5. In FIG. 6, the lower wall 35 is provided with a fluid director in the form of a convex profile formed on or presented by the inner surface of the lower wall 35. The convex profile 44 directs fluid which may be present within the boom 30 towards the junction between side walls 36 and 37 and the lower wall 35. In the embodiment illustrated in FIG. 6, drainage apertures 38 are provided in the lower wall 35 and adjacent the junction between the side walls 36 and 37 and the lower wall 35. Any fluid which enters the interior of the boom 30 and collects on the upper surface of the lower wall 35 is directed towards the apertures 38 by the convex profile 44.

FIGS. 7A, 7B and &C show views of a portion of a boom having a moisture shedding system according to another embodiment of the invention. In this embodiment, the lower wall 35 of the boom is provided with a plurality of drainage apertures 38. A plurality of fluid directors in the form of concave profiles 45 are present in the lower wall. Each concave profile 45 extend entirely across the inner surface of the lower wall and from side wall 36 to side way 37. A concave profile 45 is associated with each of the drainage apertures 38. The concave profiles 45 function to direct fluid which may collect on the inner surface of the lower wall 35 and to direct that fluid to the apertures 38 so that the fluid may escape from within the boom 30.

Figure 8:
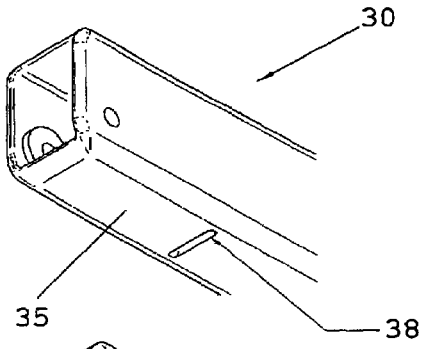
FIGS. 8, 9 10 and 11 are perspective view of part of a boom showing various alternative drainage apertures which form part of the moisture shedding system of the invention.
Figure 10:
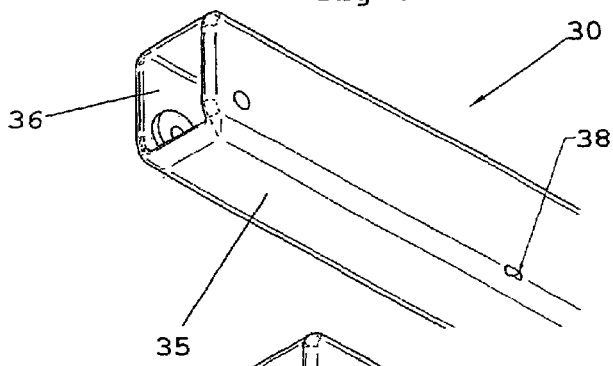
Figure 9:
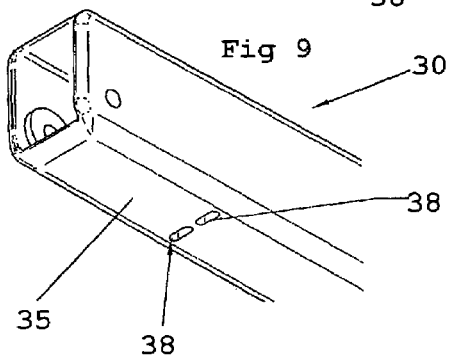
Figure 11:
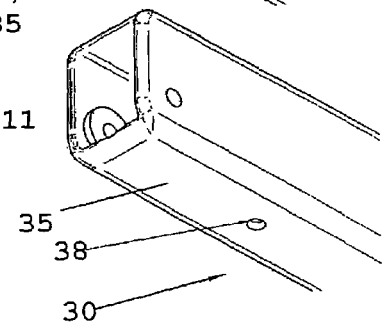

FIGS. 8, 9 10 and 11 show perspective views a portion of a boom 30. In these figures, different configurations of drainage apertures are shown. In FIG. 8, the drainage aperture consists of a slot 38 extending across and through the lower wall 35. FIG. 9 shows the drainage apertures arranged in pairs with each drainage aperture 38 being in the form of a slot formed in the lower wall 35. FIG. 10 shows the drainage aperture 38 formed as a slot in the side wall 37 and this slot is formed in the side wall 37 closely adjacent to where that wall meets the lower wall 35. In FIG. 11, the drainage aperture 38 is shown as a circular aperture.

Figures 12A, 12B, 12C, 13A, 13B, 13C, 14A, 14B, 14C:
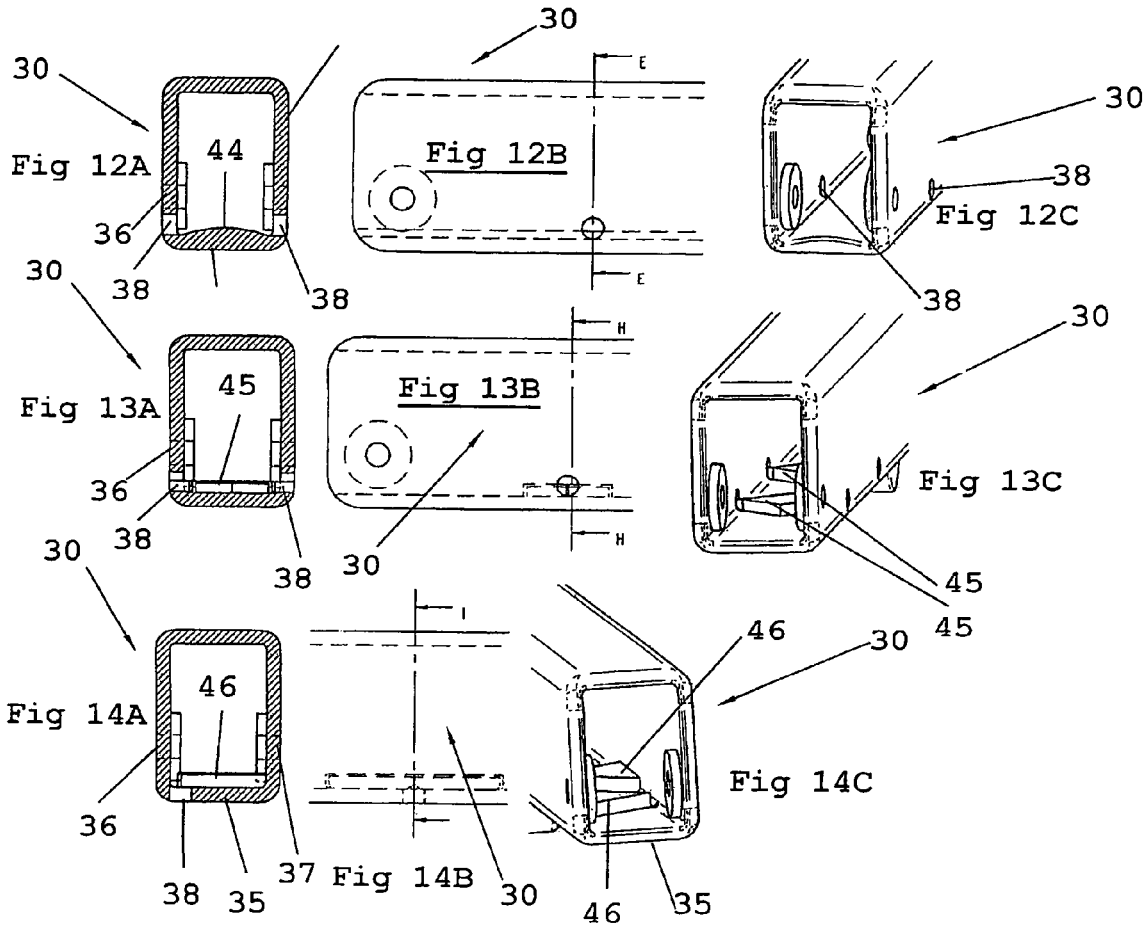
FIGS. 12A, 12B and 12C are transverse sectional, elevational and perspective views of part of a boom having a moisture shedding system according to an embodiment of the invention.
FIGS. 13A, 13B and 13C are transverse sectional, elevational and perspective views of part of a boom having a moisture shedding system according to another embodiment of the invention.
FIGS. 14A, 14B and 14C are transverse sectional, elevational and perspective views of part of a boom showing another embodiment of a drainage systems according to the invention.

FIGS. 12A, 12B and 12C show views of a portion of a boom 30. In these figures, the fluid director is provided by forming the upper surface of the lower wall 30 as a convex profile. Drainage apertures 38 are present in the side walls 36 and 37 of the boom and the convex profile 44 directs any fluid which may gather on the inner surface of the lower wall 35 towards the apertures 38 and from which the fluid may escape from the interior of the hollow boom 30. As an alternative to the moisture shedding system shown in FIGS. 12A, 12B and 12C, the inner surface of the lower wall may simply slope entirely from one of the side walls to the other side wall of the boom and apertures like apertures 38 may be formed in that side wall to which the lower wall 35 slopes. With such a configuration it is only necessary to provide drainage apertures in one of the side walls.

FIGS. 13A, 13B and 13C shows fluid director present as rhombic shaped projections 45 arranged on the inner surface of the lower wall 35 of the boom 30. A respective apex of the rhombic shaped director 45 is located adjacent the side walls 36 and 37. The side walls are provided with drainage apertures 38 and the director 35 directs any fluid which may collect on is the upper surface of the lower wall 35 towards the drainage apertures 38 and from which the fluid may escape from within the hollow boom 35.

FIGS. 14A, 14B and 14C show an alternative moisture shedding system to that illustrated in the other figures. In FIGS. 14A, 14B and 14C drainage apertures 38 (only one of which is visible) are present in the lower wall 35 and are located where that wall meets side wall 36 or 37. Triangular shaped directors 46 are arranged on the inner surface of the lower wall 35 and function to direct fluid which may collect on the upper surface of the lower side wall towards the drainage apertures 38 and those apertures allow the fluid to escape from within the boom 30.

FIGS. 15A, 15B, 15C and 15D show various views of one embodiment of a run off promoter 50 which, in this embodiment, is formed as part of the fluid director 42. In this embodiment the fluid director consists of two upstanding projections 42 which intercept in the vicinity of drainage aperture 38. The run off promoter 50 extends downwardly from the fluid director 42 and terminates in a distal reduced size end 51 which provides a sharp feature from which run off may occur.

Figures 15A, 15B, 15C, 15D, 16A, 16B, 16C, 17A, 17B, 17C:
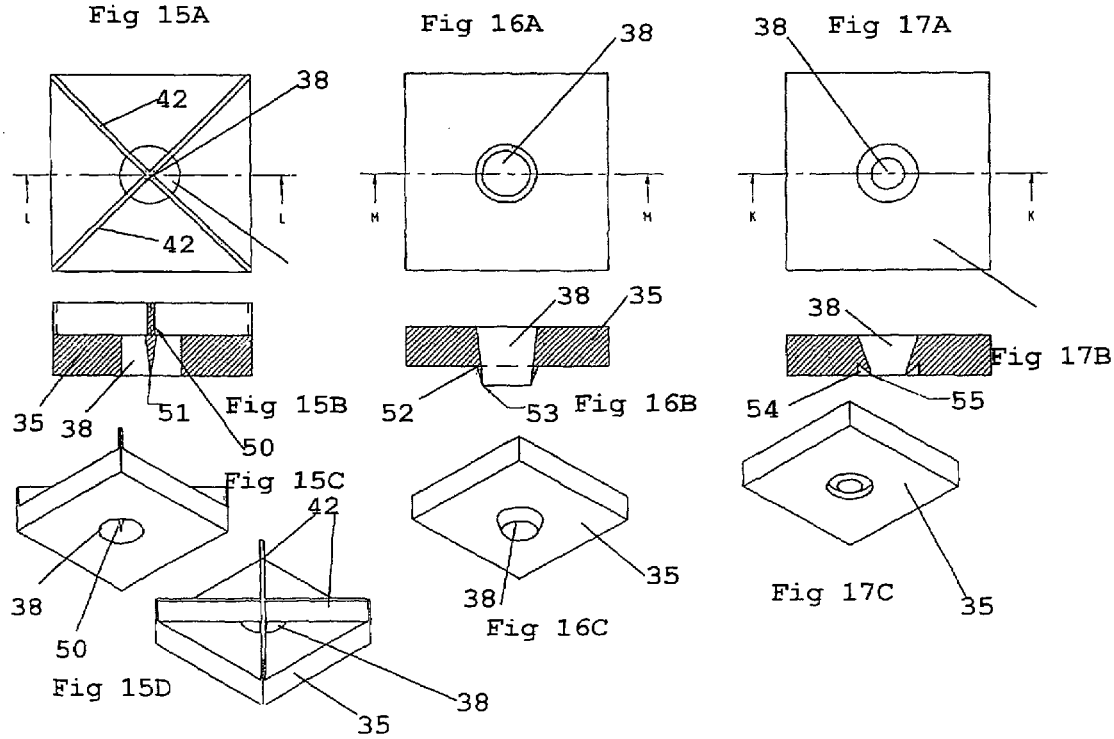
FIGS. 15A, 15B, 15C and 15D are plan, transverse sectional, bottom perspective and top perspective views of a run off formation according to one embodiment of the invention.
FIGS. 16A, 16B and 16C are plan, transverse sectional and bottom perspective views of a run off formation according to another embodiment of the invention.
FIGS. 17A, 17B and 17C are plan, transverse sectional and bottom perspective views of a run off formation according to another embodiment of the invention.

FIGS. 16A, 16B and 16C show an alternative configuration for a run off promoter, which may be used with the moisture shedding system of the invention. In this embodiment, the drainage aperture 38 is provided with a downwardly and outwardly projecting extension 52. The extension 52 functions as a run off promoter and has an outer lip 53 for this purpose.

FIGS. 17A, 17B and 17C show an alternative run off promoter to that shown in FIGS. 15 and 16. In this embodiment, the drainage aperture 38 is provided with an undercut run off promoter 54 which ensures that the outer lip 55 of the aperture 38 has a sharpened profile which promotes run off.

The run off promoters illustrated in FIGS. 15, 16 and 17 ensure that fluid which exits through the drainage apertures 38 does so in a controlled manner without dribbling along the outside surface of the lower wall 45 of the boom 30.

Figures 18A, 18B, 19A, 19B, 20, 21A, 21B:
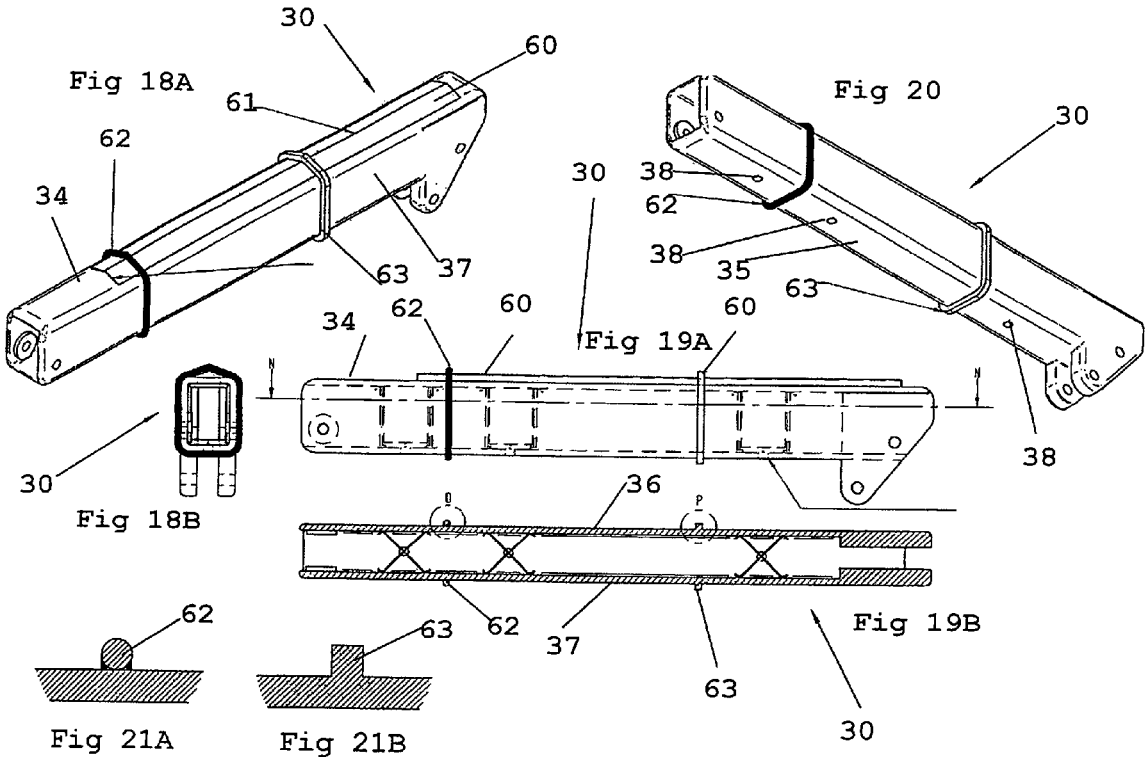
FIGS. 18A and 18B are perspective and end views of a boom which includes the water shedding system of the invention.
FIGS. 19A and 19B are elevational and longitudinal sectional views of the boom shown in FIG. 18A.
FIG. 20 is a bottom perspective view of the boom shown in FIG. 18A.
FIGS. 21A and 21B are sectional views showing possible cross sections of the water shedding band shown in FIGS. 18, 19 and 20.

FIG. 18A shows a top perspective view of a boom 30 which may incorporate a moisture shedding system according to an embodiment of the invention. FIG. 20 shows a bottom perspective view of the boom illustrated in FIG. 18A whilst FIG. 18B shows an end view of the boom 30. FIG. 19A shows an elevational view of the boom 30 and FIG. 19B shows a longitudinal section view of the boom 30 taken along lines NN. In these drawings, the upper wall 34 of the boom is provided with a cap 60 which extends at least part way along the upper wall 34 of the boom 30. The cap 60 has an apex 61 and provides for moisture shedding and directs moisture towards sidewalls 36 and 37 of the boom 30. The cap 60 provides a cavity through which hydraulic hoses may travel and the open ends at opposed ends of the cap may be filled with a suitable sealant to ensure that no moisture may enter into the cavity. Moisture shedding bands 62 and 63 are shown arranged extending around the boom 30 and at spaced locations along the length of the boom. These bands ensure that any moisture which collects on the exterior of the boom 30 is shed from the exterior surface of the boom. That portion of the bands 62 and 63 which extends along the lower wall 35 of the boom does prevent the formation of a continuous stream or track along the lower surface.

FIGS. 21A and 21B show alternative profiles for the bands 62 and 63. The bands may be formed as an integral feature of the boom or alternatively may be formed as a separate band like band 62 which may be removed from the boom 30 if the EWP is not being used in wet weather.

The invention claimed is:

1. A moisture shedding system for hollow booms having an interior and a longitudinal dimension greater than a lateral dimension, the system having at least one drainage aperture in a longitudinal wall of the boom and at least one fluid director located in the interior of the hollow boom and along at least a portion of the boom longitudinal length for directing fluid on the longitudinal wall towards the at least one aperture to thereby drain fluid from an inner surface of the longitudinal wall of the boom.

2. The system of claim 1 including a plurality of drainage apertures at spaced locations along the boom.

3. The system of claim 1 wherein the boom is rectangular in cross-section and some of the apertures are present in a lower longitudinal wall and some of the apertures are present in a lower portion of a longitudinal side wall.

4. The system of claim 1 wherein the apertures are either slots or circular holes.

5. The system of claim 1 wherein the fluid director is provided by a profile in the longitudinal wall.

6. The system of claim 5 wherein the longitudinal wall has a convex profile.

7. The system of claim 6 wherein the apertures are in the longitudinal wall and are located at a junction between the longitudinal wall and each longitudinal side wall of a pair of opposed longitudinal side walls of the boom.

8. The system of claim 6 wherein the apertures are located in longitudinal side walls of the boom and adjacent a junction between the longitudinal wall and each longitudinal side wall of a pair of opposed longitudinal side walls of the boom.

9. The system of claim 6 wherein the apertures are located in a longitudinal side wall of the boom and adjacent a junction between the longitudinal side wall and the longitudinal wall of the boom.

10. The system of claim 5 wherein the longitudinal wall has a concave profile.

11. The system of claim 5 wherein the apertures are in the longitudinal wall and a respective concave profile is associated with each said aperture.

12. The system of claim 5 wherein the apertures are provided in the longitudinal wall and the fluid director is provided by upstanding fluid directing projections on an inner surface of the longitudinal wall for directing fluid to the apertures.

13. The system of claim 12 wherein the projections extend completely across the longitudinal wall.

14. The system of claim 12 wherein the projections form weirs for directing fluid to the apertures.

15. The system of claim 1 including a run-off promoter associated with the or each of the apertures for preventing dribbling of fluid along an outer surface of the longitudinal wall.

16. The system of claim 15 wherein the run-off promoter consists of a tapered cylindrical projection extending beyond the apertures.

17. The system of claim 15 wherein the run-off promoter consists of a tapered cylindrical projection extending beyond the apertures.

18. The system of claim 15 wherein the run-off promoter consists of an undercut portion extending around the apertures.

* * * * *